US008376468B2

(12) United States Patent
Pope

(10) Patent No.: US 8,376,468 B2
(45) Date of Patent: Feb. 19, 2013

(54) APPARATUS FOR REMOVAL OF FLOOR COVERING

(76) Inventor: Donald A. Pope, Ocilla, GA (US)

( * ) Notice: Subject to any disclaimer, the term of this patent is extended or adjusted under 35 U.S.C. 154(b) by 246 days.

(21) Appl. No.: 12/698,103

(22) Filed: Feb. 1, 2010

(65) Prior Publication Data

US 2010/0201181 A1 Aug. 12, 2010

Related U.S. Application Data

(60) Provisional application No. 61/148,638, filed on Jan. 30, 2009.

(51) Int. Cl.
*B32B 31/18* (2006.01)

(52) U.S. Cl. ..... 299/36.1; 15/93.1

(58) Field of Classification Search ..... 299/36.1, 299/37.1, 1, 37.2; 15/93.1
See application file for complete search history.

(56) References Cited

U.S. PATENT DOCUMENTS 5,082,330 A * 1/1992 Holder ..... 299/37.1
5,772,284 A * 6/1998 Lindsey et al. ..... 299/36.1

* cited by examiner

*Primary Examiner* — John Kreck
(74) *Attorney, Agent, or Firm* — Brian D. Bellamy

(57) ABSTRACT

An apparatus is provided for removing at least one surface layer from a floor. The apparatus includes a body frame mountable by a machine operator. A blade tool assembly having a scraping blade is secured to the front of the main body frame by a blade holder. The blade tool may be replaced by a detachable transport wheel for moving the machine when not in use for removing floor covering. The blade holder is manipulated by attaching a hydraulic cylinder ram to the bottom side of the blade holder. The hydraulic cylinder is attached to a rear bracket attached below the body of the machine, whereby the hydraulics system for controlling the blade holder is protected. The angles and pivotal connections of the hydraulic cylinder to the blade holder permit sufficient power to operate the blade holder using an auxiliary hydraulic pump.

7 Claims, 5 Drawing Sheets

APPARATUS FOR REMOVAL OF FLOOR COVERING

PRIORITY CLAIM

The present application claims benefit of U.S. Provisional Patent Application no. 61/148,638 filed Jan. 30, 2009.

FIELD OF THE INVENTION

The present invention relates to machines for removal of floor surface coverings and particularly to an improved arrangement of hydraulics and transport wheel on such machines.

BACKGROUND OF THE INVENTION

Some prior floor surface machines use hydraulics to adjust the height and angle of a blade situated on the front of the machine. Two such machines are shown in U.S. Pat. No. 5,641,206 to David B. Craft and U.S. Pat. No. 5,772,284 to Stephen B. Lindsey and Randy D. Lindsey. In each case, a hydraulic cylinder operates a blade holder that is adjustably mounted on the front of the machine, and the hydraulic cylinder attaches to the top of the blade holder. Craft and Lindsey are typical in that the hydraulic cylinder is mounted on top of the blade holding mechanism in a conspicuous manner such that the hydraulic ram and seals are exposed. Removal of floor covering materials creates a great amount of debris that often causes damage to the components of the floor covering removal machine. In particular, on many such machines the hydraulic cylinder or other hydraulic components for operation of a blade are exposed to the ongoing debris created. This causes scarring of the hydraulic ram and gouging out of dust and pressure seals in the bottom end of the hydraulic cylinder's barrel. The problems are exacerbated by the design of the double action hydraulic cylinder barrels normally having two threaded ports for attachment of hydraulic hoses to pressurize the cylinder barrel for extension and for retraction. The debris gradually causes much damage to the hydraulics system and results in loss of use of the machine and the expense of repair. With a top mounted hydraulic cylinder, designers must be careful to make the barrel static to prevent rubbing and abrasion of hoses from surrounding structures and debris.

SUMMARY OF THE INVENTION

On a floor surface removal machine, the need for changing the blade angle using the blade holder comes from the degree of difficulty of material being removed from the floor and the wear of the original blade angle by the blade moving across floor substrate, which is usually abrasive concrete. A need exists for a new and novel approach to changing the angle of a blade on a floor surface removal machine. Such approach should avoid damage by debris to the hydraulics involved and should provide a compact streamlined design. In the present invention, a hydraulic system for operation of a blade holder is arranged beneath the blade holder and beneath other features of the machine body. The blade holder and machine body shield and protect the hydraulic elements from damage through debris such as vinyl flooring, carpet, dirt, broken pieces of wood, and especially sharp broken pieces of ceramic type flooring material. The hydraulic system adjusts the angle of the blade through manipulation of the blade holder upward and downward. To further enhance the ability of the cylinder to maintain the blade angle, side plates are provided for the blade holder to mechanically fix the blade position when removing extremely well bonded floor coverings and or coatings such as ceramic or hardwood floors.

The invention provides for attachment of the hydraulic cylinder controlling the blade holder in a specific beneficial and operable arrangement. The horizontal angle of the hydraulic cylinder with relation to the machine frame and the blade holder is determined to provide optimal performance. The hydraulic cylinder is pivotally mounted to the blade holder and the machine body by a bracket and pin at each point. The attachment points of the hydraulic cylinder are in accordance with the preferred range of the horizontal angle of the hydraulic cylinder.

It is noted that the blade holder is pivotally attached by a pivot shaft to the front of the machine body. In the present invention, the relationship between the pin attaching the hydraulic cylinder ram to the bottom of the blade holder and the pivot shaft of the blade holder is specified. The relationship between these pivot points of the hydraulic ram and the blade holder effects the preferred operation of the hydraulic system for manipulation of the blade holder.

In one embodiment, the invention may use two separate low-pressure hydraulic systems to actuate the hydraulic cylinder for manipulation of the blade holder. In using two separate hydraulic systems, each system provides a separate hydraulic pump and each pump is an infinitely variable bidirectional axial piston pump. Using separate pumps allows the operator a choice of either pump desired for this modification.

However, a second efficient and sometime preferable embodiment requires only one hydraulic system for operation of the blade holder using the hydraulic cylinder arrangement of the invention. In this case, the port hydraulic pump is equipped with an integral auxiliary hydraulic pump. A selector valve of electric solenoid switch means allows hydraulic fluid to flow to hydraulically change the angle of blade in relation to the floor. A check valve block maintains hydraulic cylinder pressure while the machine is in operation. The solenoids (one for up, one for down) are controlled by a two pole double throw switch which provides 12 volt DC power to the solenoids. Power can be 12 volt DC or any other on board available power source (220 volt AC, 48 volt DC etc.). The cylinder's hydraulic power is supplied by the auxiliary hydraulic pump and controlled by the described solenoid directional control valve and electrical control switch system.

This modification also produces another valuable function. The need for any other lifting mechanism to attach to a front transport wheel is alleviated, whether manual or electric. This unique hydraulic design for manipulating the blade holder allows the blade holder to continue upward beyond the horizontal axis of the machine to a point that allows insertion of a transport wheel. After insertion of a transport wheel, reversal of a throw switch brings the blade holder with the transport wheel attached back down into a transport position.

DETAILED DESCRIPTION OF THE PREFERRED EMBODIMENT

Figure 1:
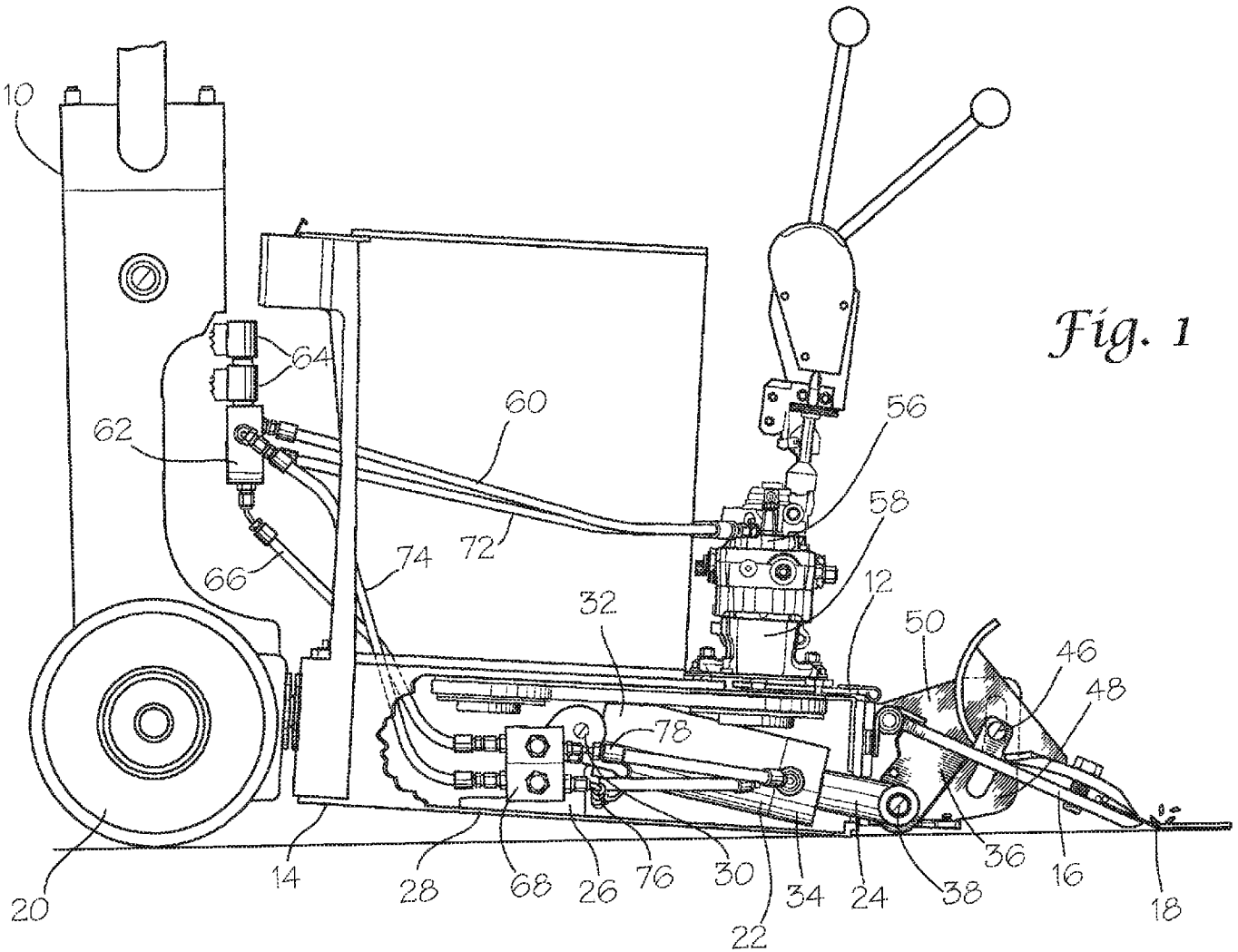
FIG. 1 shows a one embodiment of a floor surface removal machine in accordance with the invention in which a portion of the side, frame, and seat have been removed for a clear view of several novel improvements of the invention.

Referring now to the drawings, FIG. 1 shows a partial side view of a floor surface removal machine 10 illustrating the novel features of the invention. Several features common with other floor machines such as frame elements, additional hydraulics, weights, body panels, a seat and additional controls are removed for clarity. An apparatus for removal of a floor covering from a floor surface generally comprises a frame mountable by a machine operator during operation having a main body section having a front end 12 and a rear end 14. On the front end of the frame is blade holder 16 for attaching a blade tool 18 to the front end of the frame. The blade tool engages a floor covering at an angle for scraping and removing the floor covering. A rear frame section of the machine 10 is situated behind the main body section and usually includes some type of suspension attached thereto and a drive means 20 including wheels for supporting the rear frame section of the machine and driving the machine. Usually, the wheels are hydraulically driven and attached to the suspension for moving the machine and blade tool with respect to the floor surface. The sides or front of the apparatus may be equipped with weight bearing means to provide for adjustment of the force applied by the blade tool to the floor surface.

In an operating position, the blade tool 18 contacts and penetrates the floor covering being removed by bearing sufficient weight for the blade to operate on the covering. Floor surface removal machines are known to provide a jack placed on the front of the machine for providing a transport position when the apparatus is not in use. Some machines have provided permanently attached wheels beneath the front of the machine and a hydraulic cylinder attached to the top of the blade holder to lift the blade holder off the floor surface. In this arrangement, lifting the blade holder causes the front end of the machine to lower down onto the wheels. Lowering the blade holder causes the blade tool to address the floor surface at the angle desired. As discussed in the background, this methodology exposes the hydraulics on the front of the machine to damage. It is also known that the small wheels that are permanently attached have drawbacks due to their size, position and permanent attachment. Large transport wheels have been attached previously by using a jack to lift the front of the machine. However, this is inefficient.

The present apparatus overcomes the problems with transport wheels and blade holder adjustment by providing an improved hydraulic arrangement for manipulation of the blade holder 16. The main body section includes an upper frame section in the upper portion of the main body and a lower frame section beneath the upper frame section and encompassing the bottom area of the main body section. As an initial feature of the improved hydraulic arrangement, a hydraulic cylinder 22 is arranged within the lower frame section in the bottom area of the floor surface removal machine 10. This hydraulic cylinder with hydraulic ram 24 operates the blade holder that is pivotally attached to the front end 12 of the machine. Incorporating the hydraulic cylinder within the lower frame section streamlines the apparatus and protects the hydraulic cylinder and related parts from damage. The present invention overcomes problems found in attempting to locate the hydraulic cylinder within the bottom area such as the providing sufficient power to the blade holder for proper lifting, lowering and adjustment of the blade tool.

Figure 2:
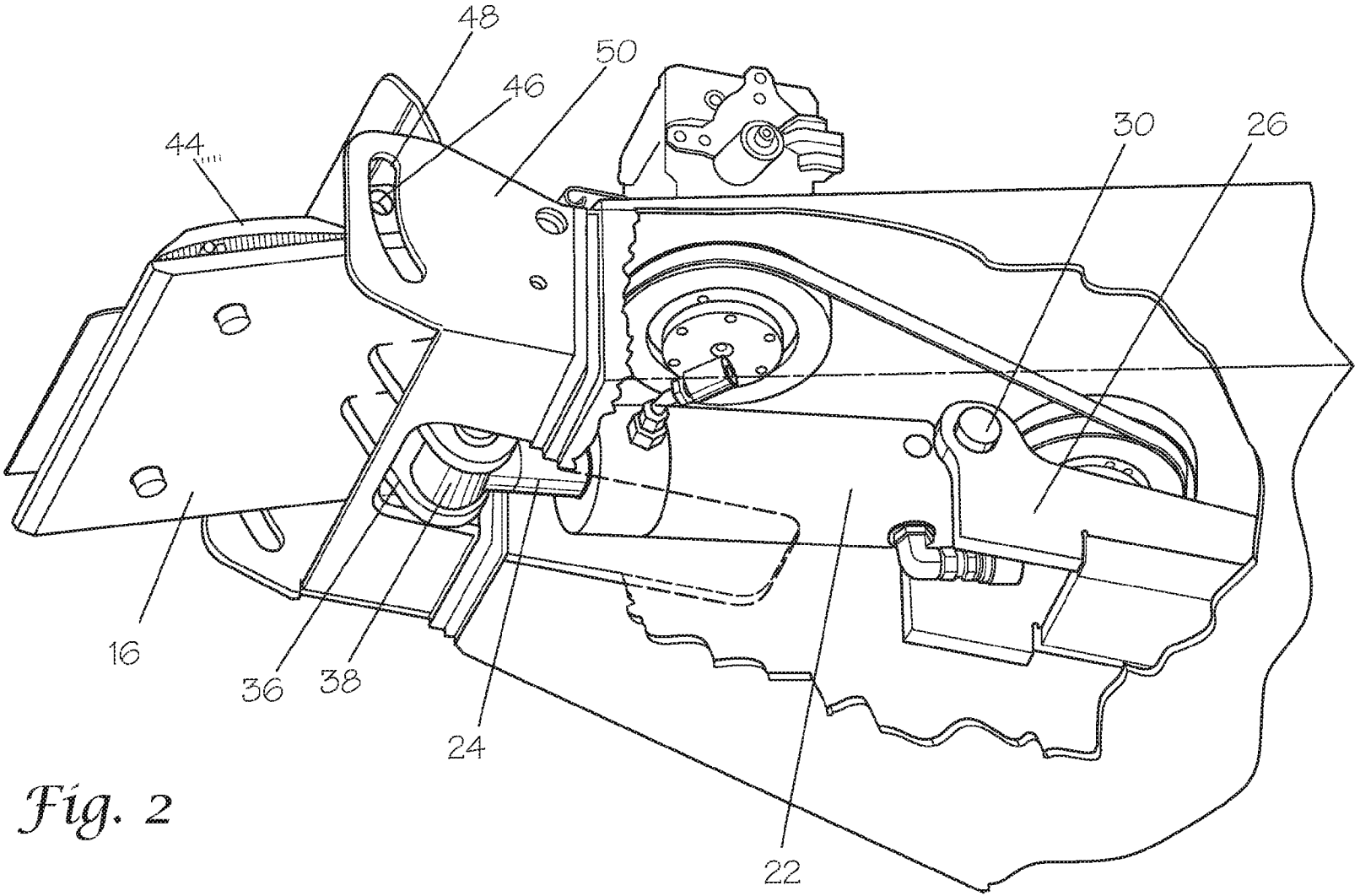
FIG. 2 shows a partial perspective view from below an embodiment of the invention.
Figure 3:
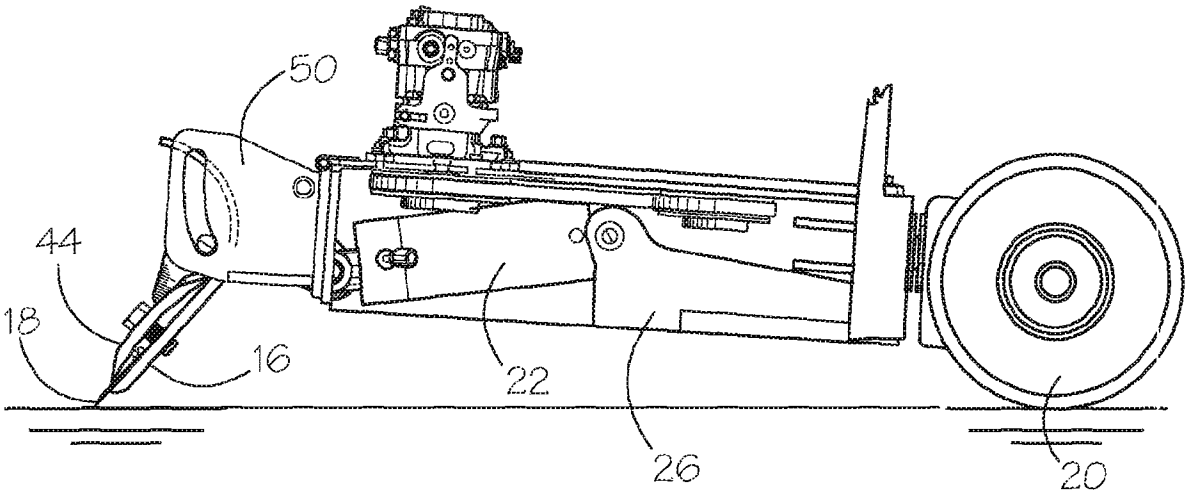
FIG. 3 shows a partial side view of an embodiment of the invention with an alternate angled position of the attached blade holder.

As shown in the embodiment of FIGS. 1-3, the hydraulic arrangement includes attaching a hydraulic cylinder 22 to a rear bracket 26 affixed to the bottom member 28 of the body frame. The hydraulic cylinder is attached to the lower frame section through via a rear bracket by a rear pin 30. The rear pin permits the cylinder to pivot upward and downward within the rear bracket. The rear bracket positions the cylinder rear end 32 higher than the opposing cylinder front end 34 where the ram 24 is attached to a front bracket 36. The hydraulic cylinder 22 shown in the embodiment has a 3 inch bore with a 4 inch stroke and a 1 inch ram.

The front bracket 36 is attached to the blade holder 16 and provides a cam-like motion for operation of the blade holder with the hydraulic cylinder 22. The connection of the front pin to the front bracket and blade holder is situated below the height of the connection of rear pin to the rear bracket within the lower frame section. The ram 24 is attached to the front bracket by a front pin 38 that permits pivoting of the ram within the front bracket.

Figure 4:
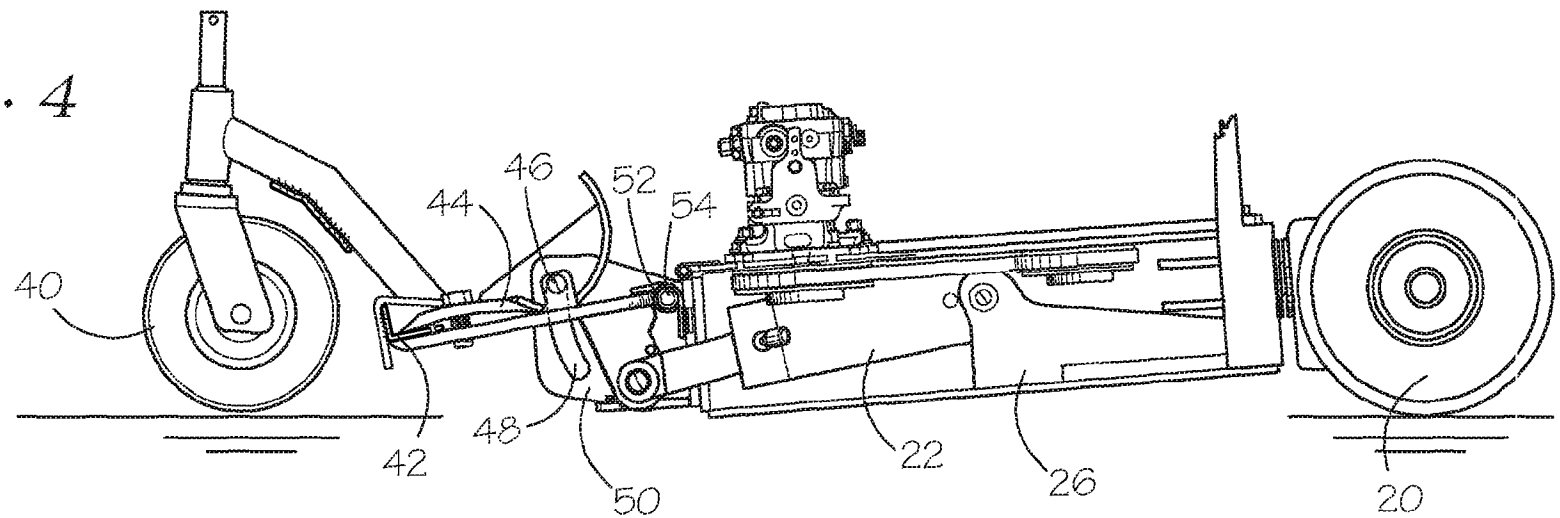
FIG. 4 shows a partial side view of an embodiment of the invention with an alternate angled position of the attached blade holder and with an attached transport wheel.

A transport wheel 40 may be attached to the blade holder by inserting a transport wheel support member 42 into a blade holder clamp 44 as shown in FIG. 4. The blade holder clamp also retains the blade tool 18 when the apparatus is operating to remove floor surface covering. The blade holder 16 is adjusted using the hydraulic cylinder 22, and a guide pin 46 attached on each side of the blade holder fits within a slot 48 on a guide member 50 attached to the body frame on each side of the blade holder. The guide pins 46 move within the slots 48 according to the angle of the blade holder 16. The blade holder is pivotally attached to the front end 12 of the machine 10 by an elongate support member 52 and an elongate shaft 54 inserted into the support member.

Figure 5:
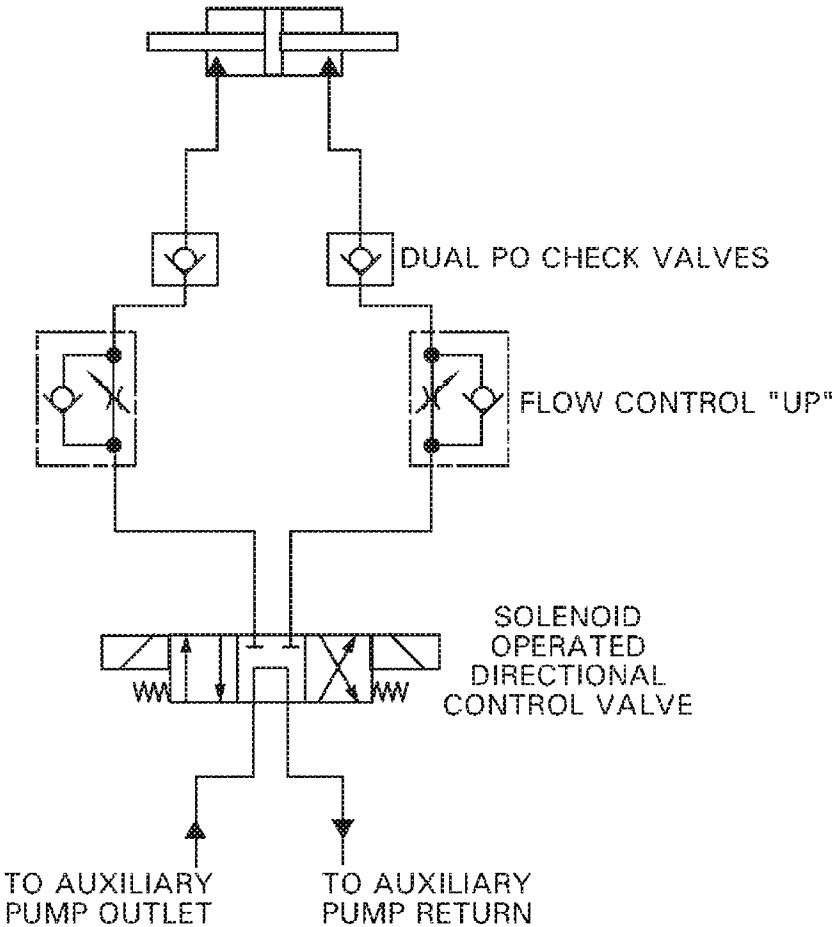
FIG. 5 shows a schematic flow chart of one embodiment of the hydraulic system arranged for controlling the blade holder.
Figure 6:
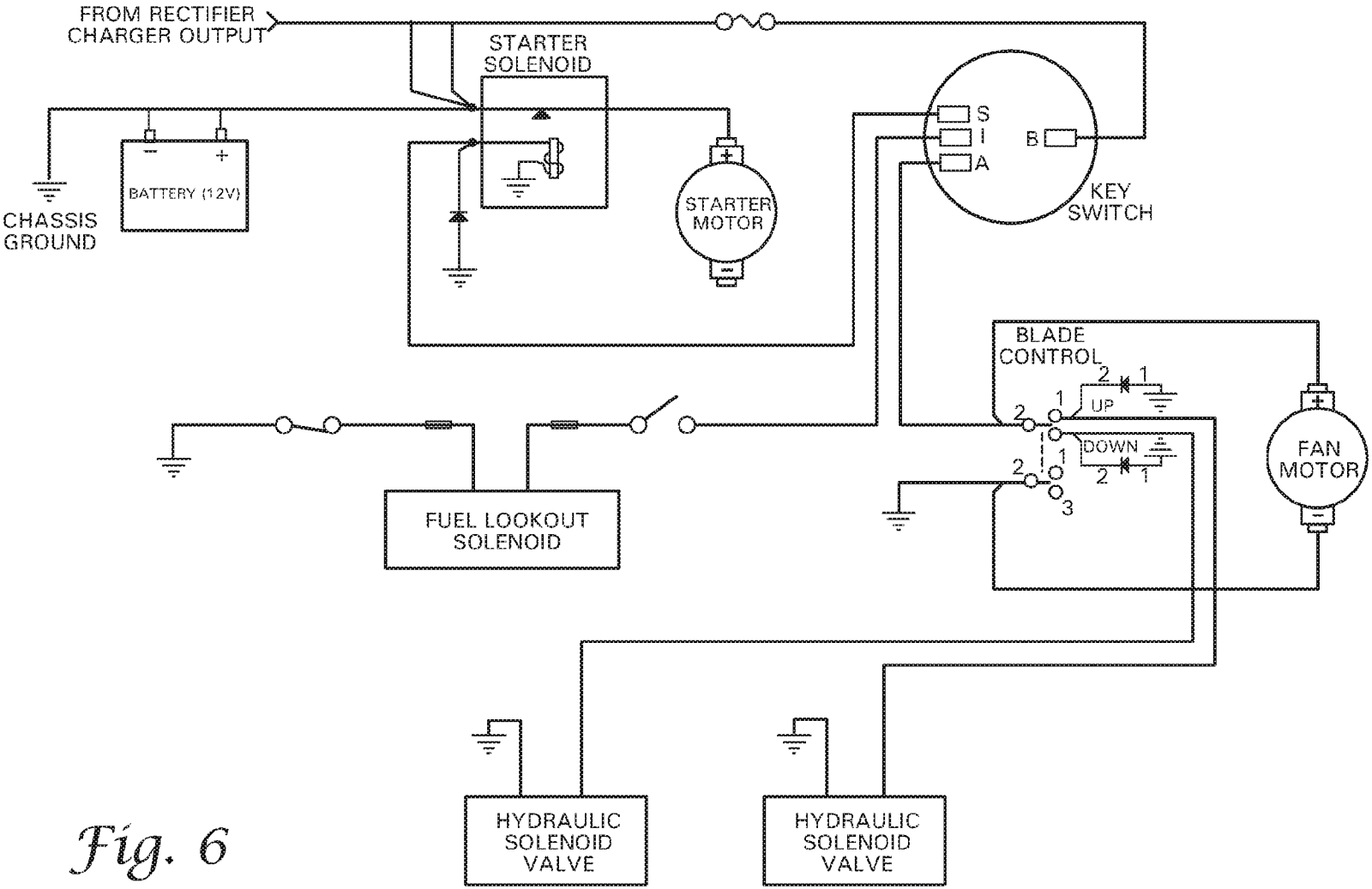
FIG. 6 shows an electrical wiring diagram of one embodiment of the electrical systems used for controlling the features of the machine including the hydraulic system for controlling the blade holder.

A preferred arrangement of the hydraulic system is shown in FIG. 1 and set forth in the schematic flow chart of FIG. 5. The hydraulic pump for operation of the blade holder is attached to the main body section, usually in the upper frame section thereof. As shown the hydraulic system for operation of the hydraulic cylinder 22 utilizes an auxiliary hydraulic pump 56 that is incorporated onto a primary hydraulic pump 58 used for controlling the drive means 20. In an "A" line, a first hose 60 carries fluid from the hydraulic pump outlet to a directional control valve 62 operated by two electrical solenoids 64, an up-solenoid and a down-solenoid. A second hose 66, and optionally a third hose, carries fluid from the directional control valve 62 to a first flow control valve 68 and then to a dual pilot operated check valve 70 and to the hydraulic cylinder front end 34, wherein providing fluid will cause retraction of the ram 24. Likewise, first, second and, optionally third, "B" line hoses 72, 74 carry hydraulic fluid from the auxiliary pump 56 return to the hydraulic cylinder rear end 32, wherein providing fluid will cause extension of the ram. The "B" line likewise transfers fluid via the directional control valve, a second flow control valve 76 and a second dual pilot operated check valve 78.

Several features of the invention include that a finite adjustable blade angle is achieved by the hydraulic circuit's fitting size and flow control valves as described in the hydraulic schematic. Further, the size and angle of the front bracket 36, acting as a cam, is designed specifically to produce the most power at different stages of the blade holder 16 angle changes. The front bracket is designed to place the most power at the angle were the front detachable transport wheel 40 makes contact with the floor. The front bracket could be moved to other positions to give more power to any position of the blade holder angle if needed. The length of the angle travel can also be impacted by the placement and angle of the front bracket. Thus, for successful operation of the blade holder, if the front bracket is positioned to have too much travel of the front pin pivot point, this detracts from the power points on the angles desired, such as when the front transport wheel touches the floor. There is a direct link to the size and shape of the arm of the front bracket to the length of the blade holder. If the blade holder is one length, the front bracket has to compliment the size and length of the blade holder. If the size and shape of the front bracket is not matched with the length and travel of the blade holder, the mechanism will not produce enough power at the critical power points on the blade holder to lift the machine. A preferred design is shown in the drawings, and as illustrated the blade holder and attachments for the blade operating hydraulics are compactly arranged within the lower frame section of the main body section of the apparatus.

The point where the cylinder rear end 32 is attached to the rear bracket 26 on the frame of the machine also effects power as the blade holder 16 angle changes. The rear bracket impacts the angle of the hydraulic cylinder 22 at which it connects to the front bracket 36. If the front bracket and the angle of the hydraulic cylinder are not designed to the produce the most power at the very precise points in the power curve, the machine will not have the power to lift the machine 10. Preferably, the blade holder shaft 54 (i.e. the pivot point of the blade holder) and the front pin 38 of the hydraulic ram 24 in the front bracket will align whereby the front pin is directly below the blade holder shaft when the transport wheel 40 is attached and first touches the floor surface when the blade holder 16 is lowered. In other words, the angle of the front bracket should cause the pivot point of the front pin to be below the pivot point of the shaft when the transport wheel touches.

The front bracket's cam arm length and position, the length and position of the rear bracket for the cylinder creates the angle of the cylinder. The angle of the cylinder and the length of the blade holder are designed in the preferred embodiment to complement each other and provide needed power and streamlined operation. If any one of these components is not appropriate, then the speed, power and travel of the blade holder could cause the mechanism to have any of the following issues: the blade holder to travel at to slow or fast rate of change, the blade holder not lift high enough to insert the front wheel or not have the power at the critical power points in the angle change to operate or lift the machine.

In the preferred embodiment several angles of components with respect to the blade holder are considered. These angles are from the high point where attached to the rear bracket to the low point where attached to the front bracket. First, with respect to the angle of the cylinder, when the blade holder is at the highest point the cylinder is at 9 degrees. When the blade is lowered to the pivot point where the most power is needed, the angle is 5 degrees, and when the blade is lowered to the lowest position, the cylinder is at 4 degrees.

Second, with respect to the angle of the blade to the horizontal plane of the machine, when the blade is raised to the highest point the blade is at a downward angle of 2 degrees. When the blade is at the pivot point where the front transport wheel makes contact with the floor surface, the blade is at a 10 degree downward angle, and when the blade is lowered to the lowest point the angle is 45 degrees.

These angles discussed are subject to a range of plus or minor a few degrees possibly in which the blade holder may be successfully operated and various tolerances may be determined. However, the present tolerances were found through experimentation to be preferable and to overcome problems with the compact arrangement of hydraulics and the provision of power needed.

The invention claimed is:

1. An apparatus for removing floor covering from a floor surface comprising:

a frame mountable by a machine operator during operation including a main body section having a front end and a rear frame section supported by wheels;

a blade holder pivotally attached to the front end by a blade holder shaft;

a blade tool attached to the blade holder;

a drive means attached to the frame for moving the frame and the blade tool;

an upper frame section and a lower frame section located within the main body section behind the blade holder;

a hydraulic cylinder with a hydraulic ram attached to the lower frame section by a rear pin via a rear bracket and attached beneath the blade holder by a front pin attached to a bottom side of the blade holder via a front bracket that is situated below the height of the rear pin within the lower frame section; and a hydraulic pump for operating the hydraulic cylinder to change the angle of the blade tool.

2. An apparatus as in claim 1 including a transport wheel and a transport wheel support member in which the transport wheel support member replaces the blade tool and inserts into the blade holder for moving the apparatus when not in use for removing floor covering.

3. An apparatus as in claim 2 in which the size and angle of the front bracket is arranged to provide a bracket arm that is coordinated with the length of the blade holder, and the blade holder shaft and the front pin align where the front pin is directly below the blade holder shaft at a point when the transport wheel is attached and first touches the floor surface while the blade holder is lowered.

4. An apparatus as in claim 1 in which the hydraulic cylinder is attached at an angle between a high point at the rear bracket where the rear pin is attached and a low point at the front bracket where the front pin is attached and the angle of the hydraulic cylinder is 9 degrees when the blade holder is at a highest position of adjustment, the angle of the hydraulic cylinder is 5 degrees when the blade holder needs the most power to operate the blade tool, and the angle of the hydraulic cylinder is 4 degrees when the blade holder is lowered to the lowest position of adjustment.

5. An apparatus as in claim 4 in which said angle of the blade tool to a horizontal plane is 2 degrees downward when the blade tool is raised to a highest point, 10 degrees downward at a point where a transport wheel makes contact with the floor surface when attached to the blade holder by a transport wheel support, and 45 degrees downward when the blade tool is lowered to a lowest point.

6. An apparatus as in claim 1 including a guide pin attached on each side of the blade holder, each guide pin fits within a slot on a guide member that is attached to the frame on each side of the blade holder, and the guide pins move within the slots according to the angle of the blade tool.

7. A floor surface removal machine comprising:

a frame mountable by a machine operator during operation;

a main body section of the frame having a front end and a rear end;

a blade holder pivotally attached to the front end of the frame for attaching a blade tool via a blade holder clamp that is attached to the blade holder and the blade tool engages a floor covering at an angle for scraping and removing a floor covering;

a rear frame section of the machine is situated behind the main body section and includes a suspension attached thereto and a drive means including wheels for supporting the rear frame section of the machine and driving the machine;

the main body section including an upper frame section in an upper portion of the main body section and a lower frame section beneath the upper frame section and encompassing a bottom area of the main body section;

a hydraulic cylinder having a ram is arranged within the lower frame section in the bottom area of the floor surface removal machine, and the hydraulic cylinder is connected by a rear pin to a rear bracket that is attached to the lower frame section and the rear pin permits the hydraulic cylinder to pivot upward and downward within the rear bracket, and the rear bracket positions a rear end of the hydraulic cylinder higher than an opposing front end of the hydraulic cylinder, and the ram is connected by a front pin to a front bracket that is attached beneath the blade holder to a bottom side of the blade holder and the connection of the ram to the front bracket by the front pin provides a cam motion and permits pivoting of the ram within the front bracket for operation of the blade holder with the hydraulic cylinder, and the connection of the front pin to the front bracket is situated below the height of the connection of the rear pin to the rear bracket, and the hydraulic ram operates the pivotally attached blade holder;

a guide pin is attached on each side of the blade holder and the guide pin fits within a slot on a guide member that is attached to the frame on each side of the blade holder and the guide pins move within the slots according to the angle of the blade holder;

a hydraulic system actuates the hydraulic cylinder to change the angle of the blade holder, and the hydraulic system includes a primary hydraulic pump for controlling the drive means and has an auxiliary hydraulic pump incorporated onto the primary hydraulic pump, and the combination of the primary hydraulic pump and the auxiliary hydraulic pump with a first flow control valve and a second flow control valve provide a finite adjustable blade holder angle; and a transport wheel is attachable to the blade holder by inserting a transport wheel support member into the blade holder clamp in lieu of the blade tool.

* * * * *